343-754 SR
3/10/81 OR 4,255,751

United States Patent [19]
Goodman, Jr.

[11] 4,255,751
[45] Mar. 10, 1981

[54] FEED MECHANISM FOR A GEODESIC LENS

[75] Inventor: Robert M. Goodman, Jr., Marietta, Ga.

[73] Assignee: Georgia Tech Research Institute, Atlanta, Ga.

[21] Appl. No.: 95,953

[22] Filed: Nov. 20, 1979

[51] Int. Cl.[3] ..... H01Q 19/06; H01Q 3/18
[52] U.S. Cl. ..... 343/754; 343/761
[58] Field of Search ..... 343/754, 761, 779, 839, 343/911 L

[56] References Cited

U.S. PATENT DOCUMENTS 3,343,171 9/1967 Goodman ..... 343/754

*Primary Examiner*—Eli Lieberman
*Attorney, Agent, or Firm*—Newton, Hopkins & Ormsby

[57] ABSTRACT

A feed system for a geodesic Luneberg lens antenna system is disclosed, in which sequential cyclical scanning of a plurality of feed sectors of the lens from one transmitter/receiver is achieved with a minimum of dead time between successive scans.

18 Claims, 3 Drawing Figures

FEED MECHANISM FOR A GEODESIC LENS

BACKGROUND OF THE INVENTION

Since a geodesic lens may be used in the transmission or reception of electromagnetic energy, it is customary to identify portions of a geodesic lens in terms of their function in the transmission of the electromagnetic energy while understanding that their functions may be reversed.

Goodman U.S. Pat. No. 3,343,171 discloses a modified helmet-type geodesic lens in which input lips are formed as partial cylinders whose axes are coincident with the major longitudinal axis of the lens and are joined to the outermost edges of the parallel plate conductors, which form the output lips of the lens, with semi-torroidal sections. This construction permits scanning the input lips along arcs centered on the longitudinal axis of the lens and displaced outwardly from the outermost edges of the output lips. In the transmission mode, focusing of collimated energy from a point source on these arcs is effected along an equi-phase line of collimated energy. The collimated energy is directed through the parallel plate conductors forming the output lips and then to a line source feed illuminating a parabolic cylinder reflector which transforms the rotating line of collimated energy to form a fan-shaped beam of collimated energy having an aperture dimension equal to the effective diameter of the lens in the scanning plane times the vertical aperture of the parabolic cylinder reflector in the non-scan plane. The fan-shaped beam in the far field of the antenna system can be moved, with exact one-to-one correspondence, by the arcuate movement of the feed horn. If the two input ports and also their associated reflectors are disposed 90° apart, movement of a feed horn along one feed arc will scan a fan beam from the first reflector which moves in a plane orthogonal to the scan plane of the second reflector. Thus, this system achieves, in one lens system, the full capability of two fan beam track-while-scan (TWS) operations which previously had required two separate lens systems such as disclosed in the Hollis U.S. Pat. No. 2,841,770.

The Hollis U.S. Pat. No. 3,018,450 discloses a rotor ring switch comprising a plurality of sectors each having an output terminating in a feed horn. Such a ring switch can be employed with the Goodman system (U.S. Pat. No. 3,343,171).

However, dead time between scans may present a serious problem.

BRIEF SUMMARY OF THE INVENTION

Accordingly, it is of primary concern in connection with this invention to provide a feed system for the Goodman type geodesic lens in which a plurality of input lips may be sequentially or simultaneously scanned with a rotor ring switch as above described, with a minimum of dead time between successive scans.

Basically, the above object is achieved by providing separate stationary coupling sectors overlying the respective input lips and positioned to feed the rotor ring switch such that no dead time is introduced by this arrangement, and by providing a further rotary coupling in the form of two semicircular sectors respectively coupled to the coupling sectors and in turn fed by a rotating semicircular sector. The number of feed horns is chosen to be large within the constraint that each feed horn element is at least equal in length to an input lip and the further rotary coupling is rotated at a speed much greater than the speed of rotation of the rotary ring switch, whereby the dead time introduced by the time required by the input junction of the rotating semicircular sector to transfer across the gaps between the two stationary semicircular sectors is minimized.

BRIEF DESCRIPTION OF THE DRAWING FIGURES

DETAILED DESCRIPTION OF THE INVENTION

Figure 1:
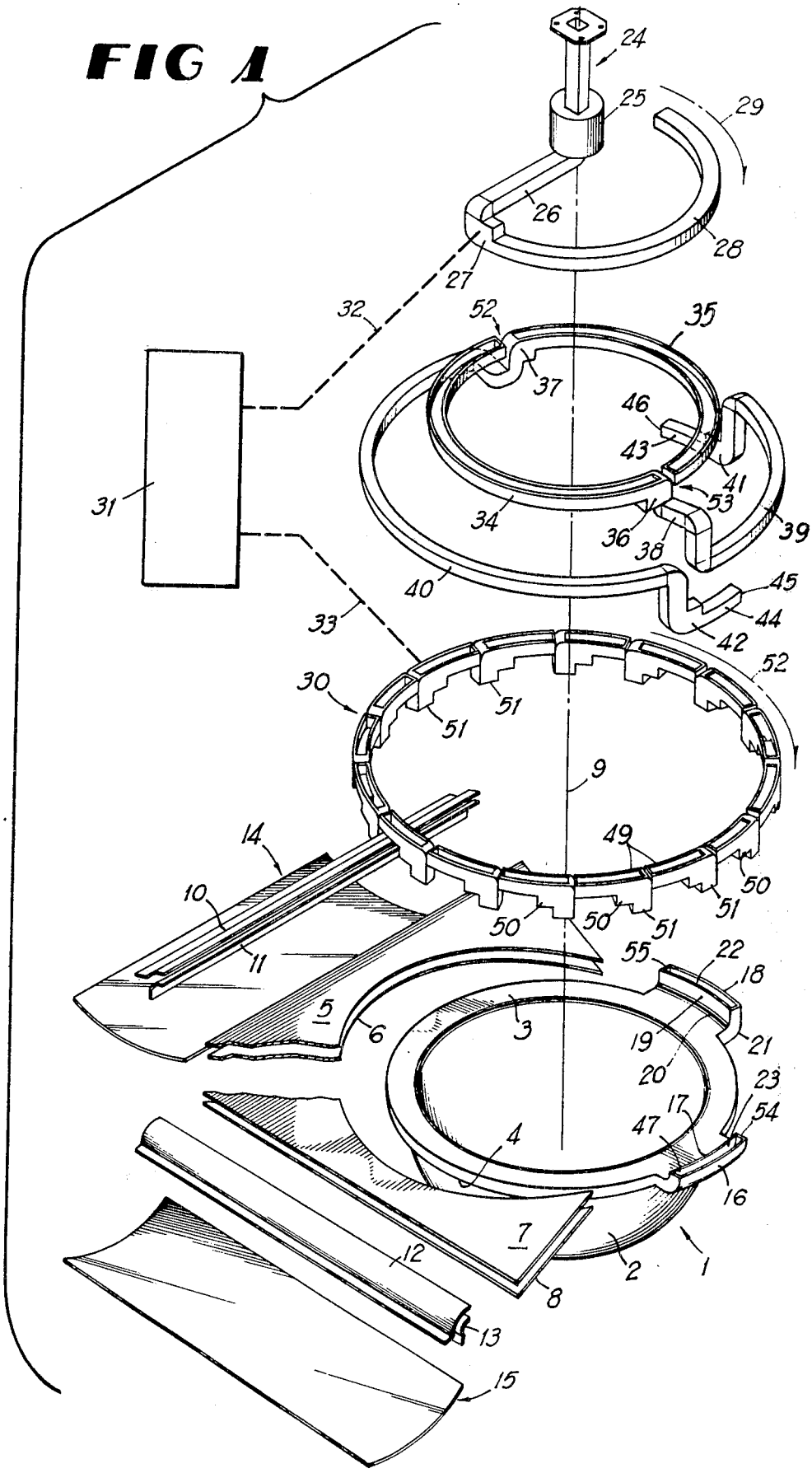
FIG. 1 is an exploded perspective of one embodiment of the invention.

In FIG. 1, a geodesic lens 1 of the type disclosed in the Goodman U.S. Pat. No. 3,343,171 includes the main body 2 formed by two dished conductors with constant normal separation provided with annular parallel plates 3 and 4 which define output lips as disclosed in the Goodman patent. Parallel plate extensions 5, 6 and 7,8 are joined to the respective plates 3 and 4 in planes coincidental therewith and perpendicular to the main longitudinal axis of the lens. The parallel plate extensions 5,6 and 7,8 are joined respectively to the reflector plates 10,11 and 12,13 which terminate in ports spaced from and illuminating the respective parabolic cylinder reflectors 14 and 15. The axes of the parabolic reflectors 14 and 15 are orthogonal and lie in a common plane perpendicular to the axis 9.

The two sets of input lips 16,17 and 18,19 are arcuate as shown and are of part-cylindrical form with the inner lips 17, 19 and the outer lips 16 and 18 circumferentially spaced by 90° and joined to the respective annular plates 3 and 4 by semi-toroidal sections such as 20 and 21, as described in the Goodman patent. Scanning along the arcuate lengths of the input ports 22 and 23 effects TWS capability as described in that patent.

Microwave energy is coupled to the main waveguide section 24 connected to a conventional transmitter/-receiver assembly, not shown, through the rotary coupling 25 having a radial arm section 26 terminating in the junction 27 leading to the rotary semicircular, longitudinally split section 28. The sector 28 is approximately 180° in extent and is centered about the axis 9 and is driven in the direction of the arrow 29 at a predetermined speed synchronized with that of the ring switch 30. Any suitable drive means may be employed and in FIG. 1, the synchronous but differential speed drive is indicated at 31 in driving connection respectively with the elements 28 and 30 as illustrated by the symbolic drive connections 32 and 33.

The two semicircular split waveguide sectors 34 and 35 are closely spaced with the rotating section 28 to couple therewith and each of the sectors 34 and 35 terminate in a junction 36 or 37 which connect through the waveguide sections 38, 39 and 40 and through the junction 41 and 42 to arcuate, split waveguide segments 43 and 44 are positioned such that their ends 46 and 45 substantially register with the ends 55 and 54 of the respective ports 22 and 23. The arcuate segments 43 and 44 therefore overlie the ports 22 and 23 and lie, of course, along a common circular path centered on the axis 9.

The rotor 30 comprises a series of contiguous arcuate split waveguide segments 49 of equal lengths forming a full complement of such elements around a circle centered on the axis 9 about which the ring 30 is driven in the direction of the arrow 52. Each segment 49 terminates at its trailing end in a junction 50 and a downwardly directed feed horn 51. The assembly consisting of waveguide sections 28, 34 and 35 therefore functions as a switch coupling the input waveguide 24 alternately with fixed segments 43 or 44 overlying the input lips of the lens. Concurrently, a horn 51 of a segment 49 of rotor 30 is scanning the length of the input lip to couple the microwave energy from the active fixed segment to the corresponding input lip.

The operation is such that the rotational speed of the rotor 30 is synchronized with that of the rotary sector 28 to assure that when the junction 27 has just traversed a gap 52 or 53 and thereby commences to activate a sector 34 or 35, a feed horn 51 coupled to the respective stationary segment 43 or 44 thus activated is coincident with the leading edge 54 or 55 of an input port 22 or 23. Obviously, then, the rotary segment 28 must be driven at a rotational speed which is N/2 times the speed of the rotor 30, where N is the number of elements 49. Thus, during the first 180° rotation of rotary section 28, sector 35 (and therefore segment 44) is activated and a horn 51 of a segment 49 of rotor 30 is traversing input lip 23 from end 54 to end 47.

Since the arcuate lengths of segments 49 and input lips 22 and 23 may be proportioned such that a horn 51 may be positioned at the beginning of scan on the ready-to-be activated lens input lip when a horn 51 is at the end of scan on the other, or activated, input lip, there is no blanking time of the transmitter required for this function. Therefore, the blanking or dead time is only required during the time necessary for the junction of rotor segment 28 to traverse either gap 52 or 53 in the upper ring switch.

Because the rotational speed of the member 28 will thus be high, the resultant dead time will be low. Typically, the dead time can be made less than 1° at frequencies in the 35 GHz range. For example, in a practical embodiment, the ports 22 and 23 each subtend an angle of 18° which permits the rotor 30 to be divided into either sixteen or twenty segments 49 in order to allow a maximum of segments within the constraint that the arcuate length of each such segment must be at least equal to the length of the ports 22, 23. The speed of the sector 28 may thus be either eight or ten times the speed of the rotor 30. However, it should be noted that if the arcuate length of 18° is chosen (twenty segments 49), one may in fact use ten double-length segments 49 since only alternate 18° sectors of the rotor are actually activated. Then, the speed of the rotary sector 28 is N/2 times that of the rotor 30, where N is a maximum number of segments 49 whose arcuate length is greater than but closely approaching the arcuate length of the input-/output ports 22, 23, regardless of whether that number, or half thereof, is used.

Figure 2:
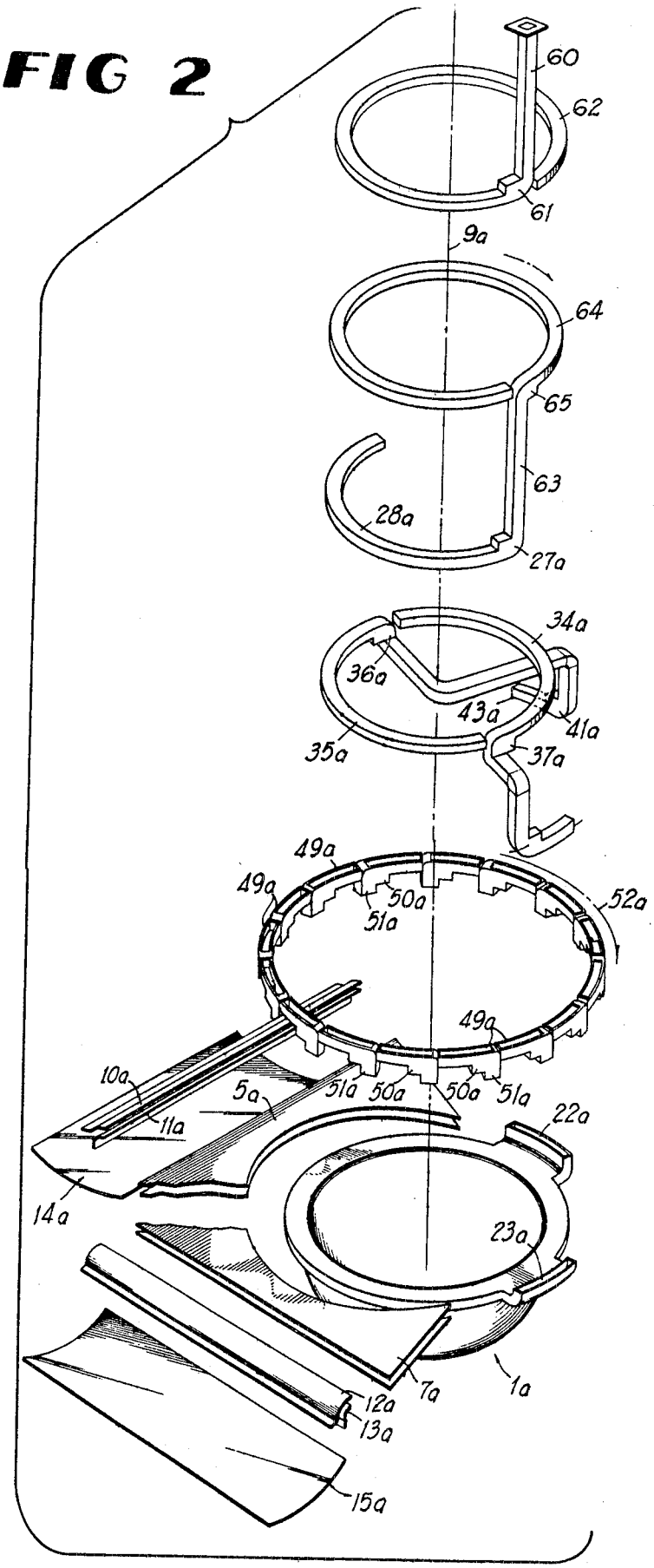
FIG. 2 is an exploded perspective of another embodiment of the invention.

In FIG. 2, a modification is shown in which the rotary coupling 25 of FIG. 1 is obviated. The main waveguide section 60 in this case is offset from the axis 9, rather than being centered thereon as is necessary in FIG. 1. The section 60 is joined, at junction 61, with the circular split waveguide ring 62. The rotary semicircular segment **28*a* is, in this case, joined through waveguide 63 with the rotating split waveguide ring 64 at junction 65. The remainder of the assembly is as described in conjunction with FIG. 1**.

Therefore, junction 61 and split waveguide 62 is the stator and junction 65 and split waveguide 64 is the rotor of an input ring switch. Similarly, junction **27*a* and split waveguide 28*a* is the rotor and junctions 37*a*, 36*a* and split waveguides 34*a*, 35*a* are the stators of a commutating ring switch. Arcuate split waveguide segments 43*a*, 44*a*, and junctions 42*a*, 43*a* are the stator, and split waveguide segments 49*a* and junctions 50*a*** are the rotor of the scanning ring switch.

Figure 3:
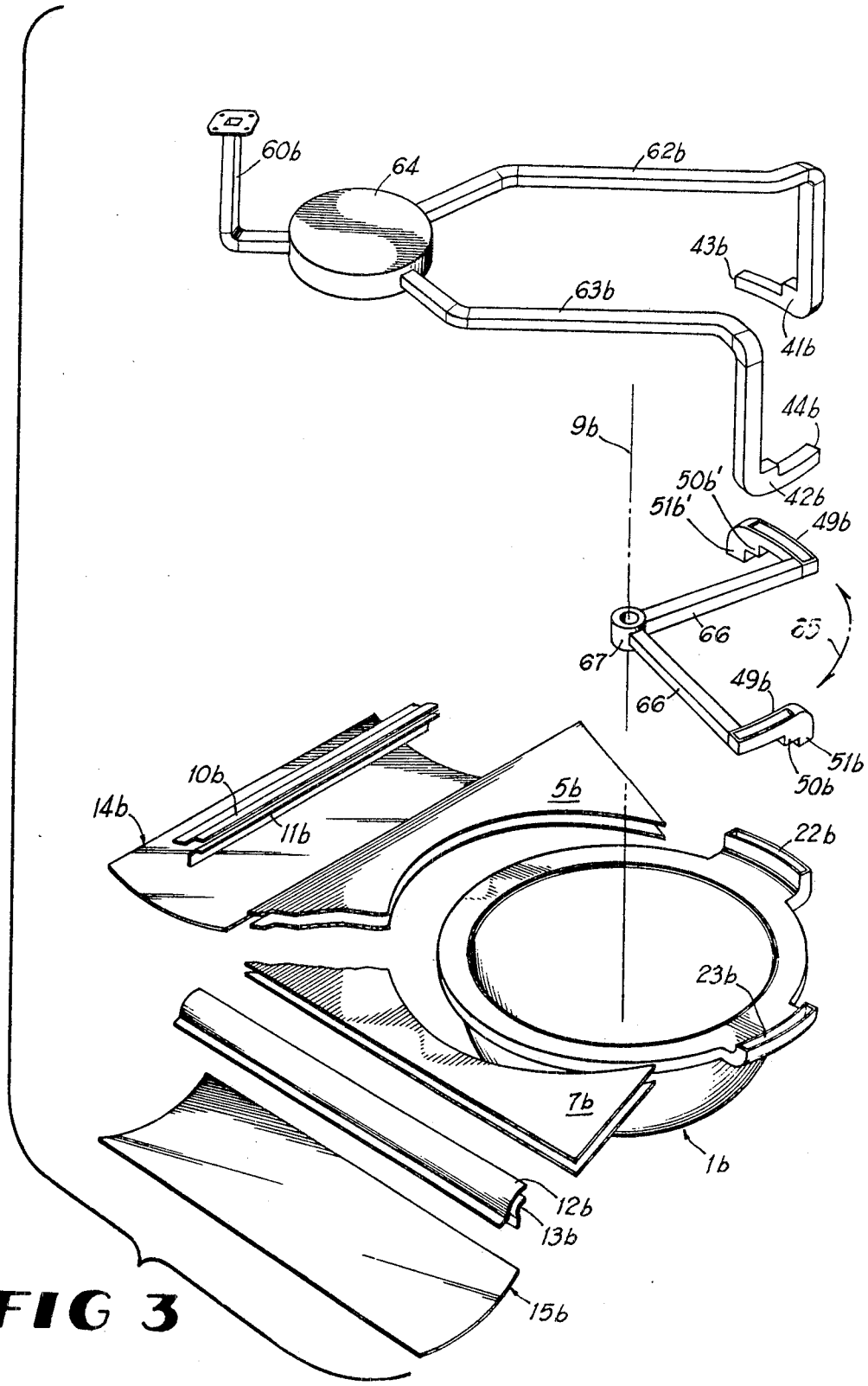
FIG. 3 is an exploded perspective of yet another embodiment of the invention.

In FIG. 3, a modification is shown in which the rotary coupling of FIG. 1 or the input ring switch of FIG. 2 is replaced by another type of waveguide switch. The main waveguide **60*b* feeds microwave energy into either a standard rotary waveguide switch of a Ferrite Switch 64. The output of the switch 64 is alternately fed to waveguides 62*b* or 63*b* and thence to arcuate segments 43*b* or 42*b* and associated junctions 41*b* and 42*b*, respectively. These arcuate segments overlie lens lips 22*b* and 23*b* in similar fashion to FIG. 1 and FIG. 2. Interposed between the arcuate segments 43*b*, 42*b* and lens lips 22*b*, 23*b* are two segmental waveguide sections 49*b*, mechanically spaced from hub 67 by means of spokes 66. These segments 49*b* perform the same function as segments 49 in FIG. 1, i.e. they receive microwave energy from the overlying waveguide segments 43*b* and 44*b* and alternately transmit this energy into the lens input lips 22*b* and 23*b* by means of their horns 51*b*' and 51*b*. In this instance, however, the assembly of the two arcuate segments 49*b* and 50*b* is caused to oscillate about axis 9*b* of the lens as shown by arrow 65 rather than rotate as was the case with the segmented ring 30 of FIG. 1. This construction as shown in FIG. 3 allows the use of much shorter path lengths from the input waveguide 60*b* to the lens input lips 22*b*, 23*b* and also minimizes the number of arcuate segments 49*b*, junctions 50*b* and horns 51*b***.

What is claimed is:

1. In combination with a geodesic Luneberg lens having a longitudinal axis, annular parallel plate conductors centered on said axis and lying in planes perpendicular thereto, said conductors defining output lips of said lens, a first set of inner and outer plates joined respectively to said parallel plate conductors and lying on spaced arcs centered on said axis and disposed outwardly of said parallel plate conductors, said first set defining a first set of input lips, and a second set of inner and outer plates joined respectively to said parallel plate conductors and lying on spaced arcs centered on said axis and disposed outwardly of said parallel plate conductors, said second set defining a second set of input lips circumferentially displaced from said first set of input lips; microwave feed means for scanning said sets of input lips along their arcuate lengths, said feed means comprising a pair of stationary, arcuate waveguide segments positioned above said input lips, a common waveguide feed section, commutating feed means for alternately coupling said segments to said common waveguide section, a rotatable ring of feed horns disposed between said waveguide segments and said input lips, said ring being centered on said longitudinal axis.

2. In the combination as defined in claim 1 wherein said rotatable ring of feed horns oscillates through an arc equal to the arcuate length of said input lips.

3. In the combination as defined in claim 2 wherein the commutating feed means is a Ferrite Switch.

4. In the combination as defined in claim 2 wherein the commutating feed means is a rotary waveguide switch.

5. In the combination as defined in claim 1 wherein said commutating feed means is rotated in synchronization with said rotatable ring but faster than said ring.

6. In the combination as defined in claim 5 including means for driving said rotatable feed means and said ring at such relative speeds such that the speed of said feed means is N/2 times the speed of said ring, where N is a number of feed horns which can be accommodated in said ring, each such feed horn having an arcuate length at least equal to and nearly the same as the arcuate lengths of said input lips.

7. In the combination as defined in claim 6 wherein each feed horn includes a second arcuate segment facing said waveguide segments and an oppositely facing feed horn outlet at one end thereof.

8. In the combination as defined in claim 7 wherein said second arcuate segments provide a full complement in said ring.

9. In the combination as defined in claim 5 including two semicircular waveguide sections coupled respectively to said arcuate waveguide segments, and a rotatable semicircular waveguide segment overlying said two semicircular segments.

10. In the combination as defined in claim 9 wherein said common waveguide sections extends along said axis and said rotatable semicircular waveguide section is directly coupled thereto.

11. In the combination as defined in claim 9 wherein said common waveguide section is parallel to but offset from said axis, and including a substantially circular waveguide section coupled directly to said common waveguide section, and a second substantially circular waveguide section directly coupled to said rotatable semicircular section.

12. In the combination as defined in claim 10 including means for driving said rotatable feed means and said ring at such relative speeds that the speed of said feed means is N/2 times the speed of said ring, where N is a number of feed horns which can be accommodated in said ring, each such feed horn having an arcuate length at least equal to and nearly the same as the arcuate lengths of said input/output lips.

13. In the combination as defined in claim 12 wherein each feed horn includes a second arcuate segment facing said waveguide segments and an oppositely facing feed horn outlet at one end thereof.

14. In the combination as defined in claim 13 wherein said second arcuate segments provide a full complement in said ring.

15. In the combination as defined in claim 9 including means for driving said rotatable feed means and said ring at such relative speeds that the speed of said feed means is N/2 times the speed of said ring, where N is a number of feed horns which can be accommodated in said ring, each such feed horn having an arcuate length at least equal to and nearly the same as the arcuate lengths of said input/output lips.

16. In the combination as defined in claim 15 wherein each feed horn includes a second arcuate segment facing said waveguide segments and an oppositely facing feed horn outlet at one end thereof.

17. In the combination as defined in claim 16 wherein said second arcuate segments provide a full complement in said ring.

18. In a microwave feed for a geodesic lens having two arcuate input ports, the combination of first rotatable means for sequentially scanning said input ports along the arcuate lengths thereof and including a full complement ring of feed horns whereby an input port is scanned during a small angular movement of said ring, and further rotatable means for alternately coupling two different horns to a common waveguide section during each revolution of said further rotatable means, and drive means for driving said further rotatable means in synchronization with but much faster than said ring whereby to minimize dead time due to switching of said further rotatable means.

* * * * *